US006850882B1

(12) United States Patent
Rothenberg

(10) Patent No.: US 6,850,882 B1
(45) Date of Patent: Feb. 1, 2005

(54) SYSTEM FOR MEASURING VELAR FUNCTION DURING SPEECH

(76) Inventor: Martin Rothenberg, 216 Oakmount Dr., Dewitt, NY (US) 13214

( * ) Notice: Subject to any disclaimer, the term of this patent is extended or adjusted under 35 U.S.C. 154(b) by 618 days.

(21) Appl. No.: 09/693,900

(22) Filed: Oct. 23, 2000

(51) Int. Cl.[7] ..... G10L 19/02
(52) U.S. Cl. ..... 704/211; 704/271; 704/214
(58) Field of Search ..... 704/211, 200, 704/208, 214, 271, 272, 276

(56) References Cited

U.S. PATENT DOCUMENTS

| | | | | |
|---|---|---|---|---|
| 3,009,991 A | * | 11/1961 | Bekey | 381/96 |
| 3,345,979 A | | 10/1967 | Miura et al. | |
| 3,713,228 A | | 1/1973 | Mason et al. | |
| 3,752,929 A | * | 8/1973 | Fletcher | 704/231 |
| 3,881,059 A | | 4/1975 | Stewart | |
| 4,247,995 A | | 2/1981 | Heinberg | |
| 4,333,152 A | | 6/1982 | Best | |
| 4,335,276 A | * | 6/1982 | Bull et al. | 704/276 |
| 4,406,626 A | | 9/1983 | Anderson et al. | |

(List continued on next page.)

OTHER PUBLICATIONS

Dorothy M. Chun, *Teaching Tone and Intonation with Microcomputers,* CALICO Journal, Sep. 1989, at 21–46.
G.W.G. Spaii, et al., *A Visual Display for the Teaching of Intonation to Deaf Persons: Some Preliminary Findings,* 16, Journal of Microcomputer Applications at 277–286 (1993).
Manfred Schroeder, *Reference Signal for Signal Quality Studies,* 44, Journal of the Acoustical Society of America, at 1735–36 (1968).
S. Hiller, et al., *SPELL: An Automated System for Computer–Aided Pronunciation Teaching,* 13, Speech Communcation, 463–73 (1993).
Martin Rothenberg, *A Multichannel Electroglottograph,* 6, Journal of Voice, 36–43 (1992).
M. Rothenberg & R. Molitor, *Encoding Voice Fundamental Frequency into Vibrotactile Frequency into Vibrotactile Frequency,* 66, J. Acoust. Soc. Am., 1929–38 (1979).
Martin Rothenberg, *Measurement of Airflow in Speech,* 20, Journal of Speech and Hearing Research, 155–76 (1977).
G.W.G. Spaii, et al., *A Visual Display System for the Teaching of Intonation to Deaf Persons,* 1991 IPO Annual Progress Report, 127–138.
"Enhance Your Therapy Sessions with Clinical Tools from Kay." Advertisement of Kay Elemetrics Corp.

*Primary Examiner*—Daniel Abebe
(74) *Attorney, Agent, or Firm*—Fulbright & Jaworski LLP

(57) ABSTRACT

A method of and device for the diagnosis and treatment of speech dynamically measures the functioning of the velum in the control of nasality during speech. Various components of oral and nasal airflow are separated and selectively analyzed including (i) the fundamental frequency component of each airflow during voiced speech, (ii) a plurality of voice components that cover a frequency range encompassing at least the lowest vocal tract resonance (the first formant), and (iii) the subsonic and infrasonic components of at least the nasal airflow. By comparing the nasal and oral airflow components at the voice fundamental frequency, a nasalization measure for voiced speech sounds is formed which emulates methods that compare low frequency nasal and oral airflow during voiced speech, while eliminating or greatly reducing the problems associated with comparing these low frequency airflows, and which improves upon previous methods based on measuring and comparing nasal and oral radiated sound pressure. A circumferentially vented screen mask (C-V mask) is configured with separate nasal and oral chambers to separate the two airflows, and causes only a minimal distortion and muffling of the voice. The separate nasal and oral airflows are detected and filtered, and a ratio of the two is formed to provide a visual display used to detect and correct abnormal or incorrect speech formation and word pronunciation.

46 Claims, 7 Drawing Sheets

U.S. PATENT DOCUMENTS 4,490,840 A * 12/1984 Jones ..... 704/276
4,569,026 A 2/1986 Best
4,641,343 A 2/1987 Holland et al.
4,681,548 A 7/1987 Lemelson
4,862,503 A 8/1989 Rothenberg
4,900,256 A 2/1990 Dara-Abrams
4,909,261 A 3/1990 Rothenberg
5,010,495 A 4/1991 Willetts
5,056,145 A 10/1991 Yamamoto et al.
5,061,186 A 10/1991 Jost et al.
5,142,657 A 8/1992 Ezawa et al.
5,197,883 A 3/1993 Johnston
5,278,943 A 1/1994 Gasper et al.
5,293,584 A 3/1994 Brown et al.
5,302,132 A 4/1994 Corder
5,307,442 A 4/1994 Abe et al.
5,315,689 A 5/1994 Kanazawa et al.
5,340,316 A 8/1994 Javkin et al.
5,357,596 A 10/1994 Takebayashi et al.
5,384,893 A 1/1995 Hutchins
5,387,104 A 2/1995 Corder
5,393,236 A 2/1995 Blackmer et al.
5,421,731 A 6/1995 Walker
5,454,375 A * 10/1995 Rothenberg ..... 600/538
5,487,671 A 1/1996 Shipiro et al.
5,503,560 A 4/1996 Stentiford
5,524,169 A 6/1996 Cohen et al.
5,536,171 A 7/1996 Javkin et al.
5,540,589 A 7/1996 Waters
5,592,585 A 1/1997 Van Coile et al.
5,634,086 A 5/1997 Rtischev
5,636,325 A 6/1997 Farrett
5,677,992 A 10/1997 Lyberg
5,717,828 A 2/1998 Rothenberg
6,109,923 A 8/2000 Rothenberg
6,155,986 A * 12/2000 Brydon et al. ..... 600/538

* cited by examiner

SYSTEM FOR MEASURING VELAR FUNCTION DURING SPEECH

BACKGROUND OF THE INVENTION

1. Field of the Invention

The invention relates to a method and device for the diagnosis and treatment of speech disorders and more particularly to the dynamic measurement of the functioning of the velum in the control of nasality during speech.

2. Description of the Related Technology

A. Velar control and oronasal valving in speech.

During speech or singing, it is necessary to open and close the passageway connecting the oral pharynx with the nasal pharynx, depending on the specific speech sounds to be produced. This is accomplished by lowering and raising, respectively, the soft palate, or velum. Raising the velum puts it in contact with the posterior pharyngeal wall, to close the opening to the posterior nasal airflow system.

This oronasal (or velopharyngeal, as it is usually referred to in medical literature) passageway must be opened when producing nasal consonants, such as /m/or /n/ in English, and is generally closed when producing consonants that require a pressure buildup in the oral cavity, such as /p/, /b/ or /s/. During vowels and sonorant consonants (such as /l/ or /r/ in English), the oronasal passageway must be closed or almost closed for a clear sound to be produced, though in some languages an appreciable oronasal opening during a vowel is occasionally required for proper pronunciation. The first vowel in the words "francais" or "manger" in French are examples of such nasalized vowels. In addition, vowels adjoining a nasal consonant are most often produced with some degree of nasality during at least part of the vowel, especially if the vowel is between two nasal consonants (such as the vowel in "man" in English).

There are many disorders that result in inappropriate oronasal valving, usually in the form of a failure to sufficiently close the oronasal passageway during non-nasal consonants or non-nasalized vowels. Such disorders include cleft palate and repairs of a cleft palate, hearing loss sufficient to make the nasality of a vowel not perceptible, and many neurological and developmental disorders. The effect on speech production of insufficient oronasal closure is usually separated into the 'nasal emission' effect that limits oral pressure buildup in those speech sounds requiring an appreciable oral pressure buildup (as /p/, /b/, /s/ or /z/) and the perceived acoustic spectral change that can be caused in vowels and sonorant consonants and is often referred to as 'nasalization'. (See Ronald J. Baken, Ph.D., Velopharyngeal Function, in *Clinical Measurement of Speech and Voice*, 393 et seq. (Little Brown & Co.—College Hill Press, 1987)). The terminology used here is that suggested by Baken, supra, who also prefers to reserve the term 'nasality' for the resulting perceived quality of the voice.

Since the action of the velum is not easily observed and the acoustic effects of improper velar action is sometimes difficult to monitor auditorially, there is a need in the field of speech pathology for convenient and reliable systems to monitor velar action during speech, both to give the clinician a measure of such action and to provide a means of feedback for the person trying to improve velar control.

B. Previous methods for measuring velar function

Previous methods are extensively reviewed by Baken, supra (Chapter 10). The less invasive methods described by Baken, supra, generally fall under the following four method categories:

1. Measuring the low frequency, primarily subsonic components of the airflow through the nose or through the nose and mouth simultaneously, often with a measure of the intraoral pressure. (Baken, supra, at 416–421; Calum Conner McLean, et al., *An instrument for the non-invasive objective assessment of velar function during speech*, Med. Eng. Phys. Vol. 19, No. 1, pp. 7-14,1997).
2. Placing an accelerometer (vibration detector) on the nose to detect sound passing through the nose. (Baken, supra, at 404–407)
3. Measuring the sound (acoustic pressure waveform) emitted from the nose and mouth, respectively, usually in conjunction with the placing of a solid sound barrier against the upper lip to improve the separation of the nasal and oral sounds, with microphones placed above and below the barrier, respectively. (Baken, supra, at 401–404; Kay Elemetrics Corp. Nasometer literature).
4. Analyzing the acoustic properties of the radiated speech to detect the acoustic properties associated with nasalization. (Baken, supra, at 398–401)

The various methods according to the present art can generally be also divided into two categories, according to the aspect of nasality being measured: (a) those that measure velar control during those consonants requiring an oral pressure buildup (as /p/, /b/, /s/ and /z/ in English), and (b) those that measure velar control during vowels and sonorant consonants. (Consonants requiring an oral pressure buildup can be further subdivided into unvoiced (as /p/ and /s/), and voiced (as /b/ or /z/). Vowels and sonorant consonants, on the other hand, are almost always voiced in non-whispered speech.) Methods in category (b), namely for measuring the nasalization of vowels and sonorant consonants, have been more difficult to implement successfully (Baken, supra, at 393).

Each of the four method categories described above has one or more serious drawbacks.

1. Methods measuring low frequency volume airflow can show well the oronasal valving patterns during voiced or unvoiced consonants requiring a strong oral pressure buildup (category (a)). However, because these methods rely on low frequency airflow components, during vowels and sonorant consonants they yield readings contaminated with significant low frequency artifacts due to lip and jaw motion and soft palate deflection. These methods also require a well-fitting mask over both nose and mouth or nasal plugs and an oral mask. The mask used can also cause a muffling of the voice (McLean, supra), though such muffling can be greatly reduced by use of a circumferentially vented mask (see below), or by using a mask incorporating one or more acoustically transparent diaphragms in the mask walls to allow the higher frequency components in speech to be more effectively radiated and also reduce deleterious acoustic loading of the vocal tract caused by the mask. Such a mask is described in U.S. Pat. No. 5,454,375. The principles of the circumferentially vented mask and the diaphragm mask can also be combined for minimal voice muffling in low frequency airflow measurements.

The other method categories focus on measurements of voiced sounds:

2. Accelerometer methods generally require adhering a small accelerometer or vibration detector to the side of the nose, and yield a measurement that is highly dependent on the vowel being spoken, the voice pitch, nose geography and the consistent placement of the accelerometer.
3. The oral/nasal sound pressure ratio methods are highly dependent on the precise geometry of the oral-nasal sound barrier used, the placement and directivity characteristics of the microphones, and the frequency range over which energy in each channel is measured. The choice of frequency range is especially problematic, since the spectral distribution in the oral and nasal channels can differ greatly, with the sound emitted from the nose consisting primarily of energy at the lower voice harmonics. Thus if too wide a bandwidth is used, such a system would be comparing the energy in mostly lower frequency voice harmonics emanating from the nose with the energy of mostly higher frequency harmonics from the mouth. For a popular commercial version of this method, the Nasometer, and its previous research version, TONAR II, this frequency range has been empirically chosen to be approximately 300 to 800 Hz (Baken, supra), presumably to both capture some of the nasal energy, which is limited to lower frequencies, and to capture the energy of the first or lowest vocal tract resonance (the first formant) for most vowels and sonorant consonants. However, since the directivity of even a directional microphone at the lower frequencies of this range is limited by the long wavelengths (approximately 3.3 feet at 300 Hz), there is necessarily some appreciable sound crossover between the oral and nasal channels (assuming reasonable proportions for the sound barrier against the upper lip). Because of the inclusion of the first formant energy in the oral signal, there is a dependence in this method on the vowel or consonant being spoken. There is also a dependence on the voice pitch, since the filter range chosen includes the strong fundamental frequency component for some values of voice pitch but not for others.

4. In the fourth class of methods, the spectrum of the radiated pressure waveform during voiced speech is analyzed to determine the degree of nasalization. However, in attempts to do this it has been difficult to obtain meaningful quantitative results (Baken, supra). The effect of incomplete velopharyngeal closure on the spectrum of a voiced speech sound is highly variable between speech sounds and is highly dependent on the acoustic properties of the nasal passages. For example, consider the great changes in the acoustic quality of a spoken vowel produced when the nasal passages are partially occluded by nasal congestion during a cold. Thus readings for the same level of velar control could vary greatly from day-to-day, even for the same subject.

SUMMARY OF THE INVENTION

It is an object of this invention to avoid problems inherent in previous methods for measuring nasalization of voiced speech, by measuring the amplitude of airflow components in certain voice harmonics for the separate oral and nasal flows. Adaptation is also described for providing simultaneous measurement of unvoiced nasal emission by simultaneously recording and displaying low frequency, primarily subsonic airflow components.

It is a further object of this invention to avoid the problems in methods that measure nasalization during voiced speech from the ratio of the low frequency components of the oral and nasal airflow-components in the range of zero to about thirty Hz. To accomplish this, the proposed method measures the nasal and oral voice airflow components at the voice fundamental frequency and computes a ratio of the energy in these voice components. This ratio reflects well the nasal and oral division of low frequency glottal airflow while being much more impervious to airflow artifacts caused by articulatory movements. Since these artifacts have a spectrum in the range of zero to about twenty or thirty Hz, well below the frequency range of the voice harmonics, which start at about 80 Hz for adult men and 150 Hz for women and children, they can be eliminated in the proposed method by high pass filtering at a frequency just below the lowest expected voice fundamental frequency.

To further understand why the amplitude of the fundamental frequency component is a preferable substitute for low frequency airflow in the measurement of nasalization of voiced speech it should be understood that the amplitude of the fundamental frequency component correlates strongly with the low frequency airflow at the glottis. The laryngeal voice source operates by valving on and off the flow from the lungs at the rate at which the vocal folds vibrate, to produce pulses of air of a rather simple shape and a duty cycle of roughly 40% to 60%. The amplitudes of these laryngeal flow pulses are, in turn, reflected well by the amplitude of the fundamental frequency component of the total flow waveform. Taking into account the aforementioned range of pulse duty cycle, the average airflow during voicing, as would be measured by low pass filtering, is roughly 40% to 60% of the peak pulse amplitude, except during very breathy voicing. Thus the low frequency airflow is approximately 40% to 60% of the peak-to-peak amplitude of the fundamental frequency component during most voiced speech.

It is a further object to avoid certain of the deficiencies in the method constructed according to the prior art for measuring voice nasalization by measuring the energy in radiated oral and nasal sound pressure and forming a ratio. This is accomplished by making equivalent oral and nasal airflow measurements over a frequency range similar to that used in the pressure-based method and converting to the equivalent oral and nasal pressure waveforms by a process of differentiation. (The conversion of airflow to pressure by differentiation has been demonstrated and described in Martin Rothenberg, *Measurement of Airflow in Speech*, Journal of Speech and Hearing Research, Vol. 20, No. 1, pp. 155–176 (March 1977) (hereinafter "Rothenberg 1977")). The proposed airflow-based system attains a better separation between oral and nasal acoustic energy than does the equivalent pressure-based system, since in the frequency range being measured there is very little crosstalk between oral and nasal channels when airflow is being measured as compared to pressure. Airflow-based measurement at the mouth or nose also results in energy ratio measurements more imperviousness to external noise, including other voices, as compared to measurements obtained with even a good directional microphone.

Also avoided in substituting (ac) voice fundamental frequency measurements for (dc) low frequency measurements are the zeroing and zero drift problems inherent in the sensitive pressure transducers required for the low frequency measurements. The proposed method can use inexpensive audio microphone elements that require no zeroing.

In the proposed method, measurement of low frequency airflow components (0 to about 30 Hz) is left as an option for monitoring nasal leakage primarily during unvoiced consonants requiring an oral pressure buildup (nasal emission). In this latter application, the nasal flows are much greater than in vowels, and the measurement problems thus less severe.

The ratio of nasal and oral airflow energies at the fundamental frequency is also much less sensitive to nasal passageway geometry and nasal congestion than acoustic (radiated sound pressure) methods that analyze higher frequency oral and nasal resonances to estimate nasalization (method category (4) above).

Similarly, unlike acoustic methods constructed according to prior art, the aspect of proposed method that measures the ratio of nasal and oral airflow energies at the voice fundamental frequency is relatively insensitive to the vowel being produced. As the vocal mechanism goes from vowel to vowel, it is primarily the energy at the higher harmonics that is being varied, and not the amplitude of the fundamental frequency component.

According to the invention, voice frequency airflow components emanating from a subject's nose and mouth are analyzed and compared. By comparing the nasal and oral airflow components at the voice fundamental frequency, a nasalization measure for voice speech sounds can be formed which emulates methods that compare low frequency nasal and oral airflow during voiced speech, while eliminating or greatly reducing the problems associated with comparing these low frequency airflows. Further, by comparing the energy of nasal and oral airflow components covering a frequency range of at least the lowest vocal tract resonance (the 'first format'), anasalization measure for speech sounds can be formed which emulates methods that compare nasal and oral radiated acoustic sound pressure over the same frequency range, while eliminating or greatly reducing the problems associated with the pressure-based methods. There is available at least one airflow measurement mask suitable for voice frequency measurements, namely, the circumferentially vented screen mask (C-V mask). A C-V mask can be configured with separate nasal and oral chambers to separate the two airflows, and causes only a minimal distortion and muffling of the voice. It has been shown that airflow components to over 1 kHz can be measured reliably with this type of mask, a range adequate for the measurement of nasality. (Martin Rothenberg, "*A New Inverse-Filtering Technique for Deriving the Glottal Airflow Waveform During Voicing*," Journal of the Acoustical Society of America, Vol. 53, No. 6, pp. 1632–1645 (1973) (hereinafter "Rothenberg 1973)

Since the voice frequency airflow method described can be implemented with only a mask, two relatively inexpensive microphone elements, and suitable software running on a standard multimedia digital computer, inexpensive versions suitable for home use in training regimes are possible.

An embodiment of the proposed system for measuring nasalization according to one aspect of the invention would contain at least the following elements:

1. A means for recording the ac volume airflow from the mouth and from the nose, such means having a frequency response from at least 80 to 350 Hz and preferably to at least 800 Hz. This means could be a Dual Oral/Nasal C-V mask with pressuresensitive microphones in each of the two chambers,
2. An analysis subsystem for filtering each microphone output, measuring the amplitude of each filtered output, and computing a ratio of the nasal and oral amplitudes, for example as either nasal/oral (assumed in the discussion below) or nasal/(oral+nasal).
3. A display subsystem for displaying the result of such ratio computation to the user or a clinician, as in the form of a trace on a computer screen or a number or numbers representing the measured index or indices of nasalization.

The two subsystems described for analysis and for display could be implemented by means of a digital computer program, with the signals from the microphones or other pressure sensors input to the program through an analog-to-digital (A-D) converter. Such converter could possibly be the stereo audio A-D converter in the computer's audio system. Alternatively, all or part of the analysis or display systems could be readily implemented by means of analog circuitry, dedicated digital circuitry, application-specific integrated circuitry (ASIC), etc.

The type of filtering used in item 2 could be made selectable by the user. If the filter mode used is such that only the fundamental frequency component is to be selected, a measurement of fundamental frequency could also be made, to control the frequency range of the filter. (Measurements of voice fundamental frequency from combined oral and nasal airflow are simple to implement and quite reliable (Rothenberg 1977).)

In one embodiment, a band pass filter that passes frequencies within a range of approximately 300 to 700 Hz (i.e., the approximate range used in the Nasometer) could be used in each channel, with a differentiation operation added either before or after each filter.

Other features or variants envisioned for the system described in this disclosure include a means for normalizing the nasalization indication for slight-to-moderate nasal congestion. With no congestion, the ratio of nasal to oral airflow at the fundamental frequency approaches unity for a maximally nasalized open vowel such as /a/. Normalization means can be provided such that this ratio is close to unity even with a moderate degree of nasal congestion.

Also envisioned is a display feature that delineates the presence of nasal consonants, which can be detected as periods in time during which the nasal/oral ac flow ratio significantly exceeds unity.

In addition, a low frequency pressure transducer can also be coupled to the nasal chamber of the mask or such transducers coupled to both mask chambers, to measure unvoiced nasal airflow or both nasal and oral airflows, in order to record the possible nasal flow components in unvoiced consonants requiring a buildup of oral pressure.

More particularly, according to one aspect of the invention, an apparatus for indicating speech characteristics related to the degree of closure of the oronasal passageway includes detectors sensitive to oral and nasal airflows to provide respective oral and nasal airflow signals over a predetermined usable frequency response range. A filter receives the oral and nasal signals and attenuates energy at frequencies outside a predetermined range of voice fundamental frequencies to provide filtered oral and nasal signals. A processor calculates a ratio value reflecting a ratio of the energy values of the filtered oral and nasal signals. The ratio value is then presented on a visual display.

According to a feature of the invention, a mask shaped to cover both the mouth and nose of a subject includes separate oral and nasal chambers to direct respective airflows, which may then be subject to detection by suitable transducers. The mask may include a dual oral/nasal circumferentially vented screen mask having pressure-sensitive transducers respectively coupled to the oral and nasal chambers of the mask. To minimize distortion of the speech, the mask is preferably acoustically transparent.

According to another feature of the invention, the detector includes respective oral and nasal airflow transducers which may take the form of respective velocity microphones or respective airflow limiting devices which restricts airflow to provide a pressure gradient which is subject to detection by inexpensive pressure sensors (e.g., dynamic microphones, etc.).

According to another feature of the invention, a converter receives the filtered oral and nasal signals to provide a digital format signal which is received by a digital computer performing the filtering and processor functions. According to another feature of the invention, a signal differentiator is configured to provide a value representing a time rate of change of the oral and nasal airflow signals.

According to still another feature of the invention, a memory stores idealized templates representing normal or target speech corresponding to predetermined utterances such as words and word segments, phrases and sentences.

According to another feature of the invention, a processor is configured to calculate the ratio represented by the low frequency component of the nasal airflow divided by the sum of (a) a low frequency component of the oral airflow plus (b) the low frequency component of the nasal airflow.

According to yet another feature of the invention, an audio reproduction device is included which stores and reproduces audio frequency components of the oral airflow signal, the nasal signal, or the combined oral and nasal signals.

According to another aspect of the invention, an apparatus for measuring the degree of closure of the oronasal passageway during speech includes a mask shaped to simultaneously cover the mouth and nose of a subject, the mask having separate oral and nasal chambers for directing respective oral and nasal airflows. Oral and nasal transducers are mounted in communication with the respective oral and nasal chambers, each of the oral and nasal transducers operative to respectively detect the oral and nasal airflows and provide respective oral and nasal airflow signals over a predetermined usable frequency response range. Corresponding oral and nasal signal bandpass filters receive the oral and nasal airflow signals from the oral and nasal transducers and supply respective filtered oral and nasal signals in which energy at frequencies outside a predetermined voice fundamental frequency range is substantially attenuated. A comparator function responds to the filtered signals to provide a ratio value reflecting a ratio of (i) an energy value of the filtered oral signal and (ii) an energy value of the filtered nasal signal. A display provides a visual indication of the ratio value computed by the comparator.

According to features of the invention, the mask is a dual oral/nasal circumferentially vented screen mask and the oral and nasal transducers are pressure-sensitive microphones respectively coupled to the oral and nasal chambers of the mask.

According to another feature of the invention, the oral and nasal airflow signals are supplied to an analog-to-digital converter of a digital computer. The digital computer also provides a software implementation of the (i) oral and nasal signal bandpass filters, (ii) comparator, and (iii) display functions. An output from the display functionality is provided to and displayed by a computer monitor associated with the computer.

According to another feature of the invention, the oral and nasal transducers have a frequency response range including a predetermined multiplicity of human voice harmonics up to and including 800 Hz. The bandpasses of the oral and nasal signal bandpass filters are designed to include at least a predetermined lowest formant of the human vocal tract for the class of speakers for which the apparatus is intended, the oral and nasal signal bandpass filters each having lower and upper frequency half power points (i.e., −3 dB frequencies or "corners") within respective ranges of 200 to 450 Hz and 550 to 800 Hz, and preferably within the ranges of 300 to 400 Hz and 600 to 700 Hz, optimal lower and upper half power points being approximately 350 and 650 Hz, respectively.

According to another feature of the invention, the oral and nasal bandpass filters each can include a signal differentiator operable for converting the oral and nasal flow signals to approximations of the respective oral and nasal radiated acoustic pressure signals.

According to another feature of the invention, a separate low frequency nasal chamber transducer is included to provide a nasal low frequency signal corresponding to low frequency airflow components of the nasal airflow, including the zero frequency (constant flow) component. A corresponding low frequency bandpass filter receives an output of the low frequency nasal chamber transducer and acts on the output to attenuate voice frequency energy from the output. This low frequency bandpass filter preferably has a half power point falling within a range of 20 to 40 Hz so as to attenuate signals having frequencies exceeding the design cutoff corner value. The filtered output may be used to provide a low frequency display representing the low frequency airflow components of the nasal airflow during either voiced or unvoiced speech sounds.

According to another feature of the invention, the mask may further include a low frequency oral chamber transducer configured to provide an oral low frequency signal corresponding to low frequency airflow components of the oral airflow. Outputs from the low frequency nasal and oral transducers may be provided to a comparator which computes a ratio of a value of the nasal low frequency signal to a value of the oral low frequency signal. This may be accomplished by calculating (i) the amplitude value of the nasal low frequency signal divided by (ii) a value representing a sum of (a) the amplitude value of the oral low frequency signal plus (b) the amplitude value of the nasal low frequency signal.

According to another feature of the invention, an audio recorder facility is included for storing and reproducing speech signals in correspondence with associated airflow signals. Playback of the speech may be coordinated and synchronized with the visual display of airflow and ratio values.

These, together with other objects, advantages, features and variants which will be subsequently apparent, reside in the details of construction and operation as more fully hereinafter described in the claims, with reference being had to the accompanying drawings forming a part thereof, wherein like numerals refer to like elements throughout.

DETAILED DESCRIPTION OF THE PREFERRED EMBODIMENTS

Figure 1:
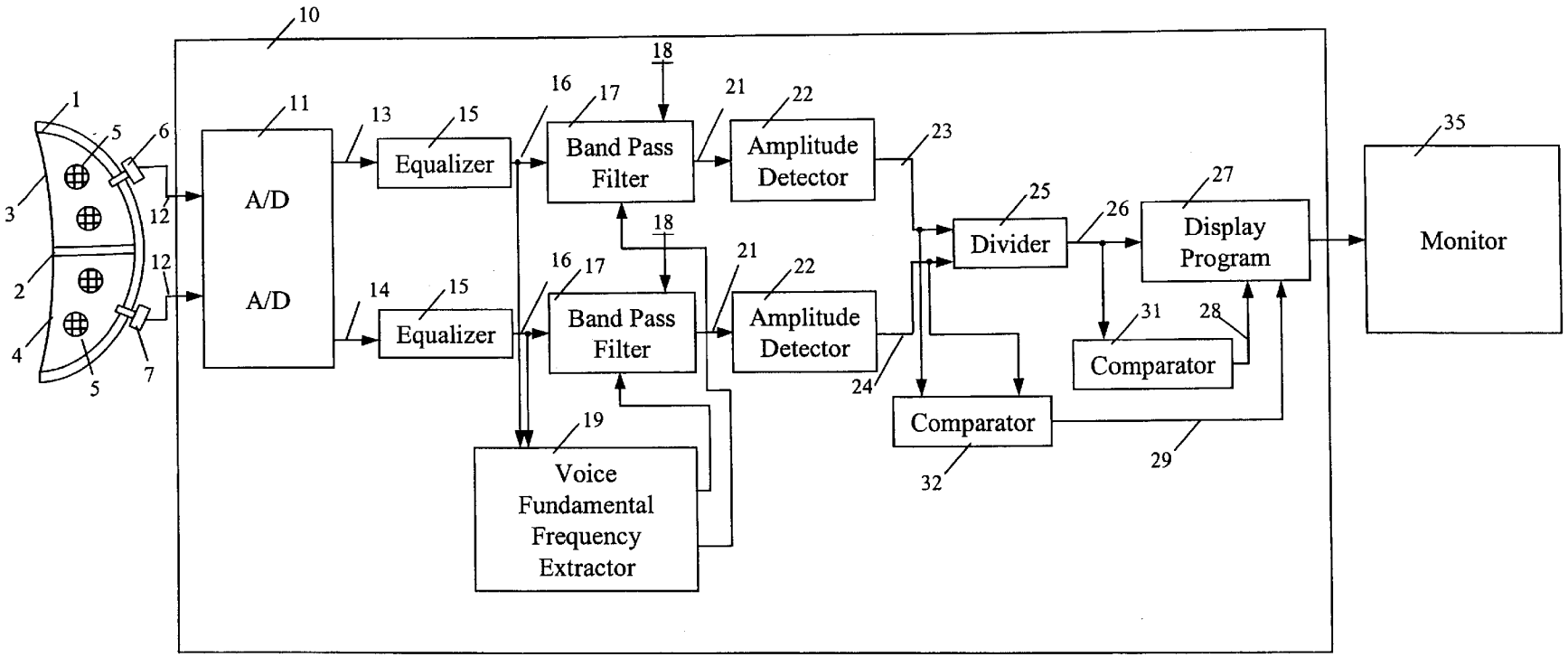
FIG. 1 is a block diagram of a device for the detection, measurement, and display of nasalization.

The apparatus and method presented herein preferably employ a mask to separately capture and measure the oral and nasal airflows at frequencies of up to at least 350 Hz, and preferably to over 800 Hz. In order to have an adequate frequency response, this mask should not introduce its own resonances in the required frequency range. The mask must also preferably have a minimal effect on the resonances of the vocal tract and produce a minimal muffling of the speech, so that the acoustic properties of the speech are not significantly perturbed and can be clearly heard and recorded.

In traditional masks used for respiratory measurements, and sometimes adopted to low frequency speech measurements (such as the Super Nasal Oral Ratiometry System (SNORS) of the University of Kent and Aerophone air-flow measurement system manufactured by Kay Elemetrics Corp.), the mask has solid walls relatively impervious to sound, and serves only to funnel the flow to a transducer that measures the flow rate. Often this transducer is of the type in which a small resistance to flow in the form of a fine mesh screen is introduced into the flow path at the mask exit and the resulting pressure drop across the screen measured, though other transducers may be used (see, e.g., McLean, supra). However, solid wall masks cannot provide reliable measurements of airflow in the voice frequency range and can cause a considerable distortion and muffling of the voice.

For airflow measurements during speech, it is usually preferable to use a mask in which the screen flow resistance is incorporated into the mask wall by distributing it on the surface of the mask, as close to the mouth as practical. This mask configuration can have both of the above-mentioned desirable properties, namely, a potential frequency response flat to at least 1000 Hz and a minimal distortion and muffling of the voice. (Rothenberg 1973; Rothenberg 1977). This type of mask, developed by the inventor of the subject invention for the noninvasive study of the pattern of laryngeal airflow by the technique of inverse filtering, was termed a circumferentially vented wire-screen pneumotachograph mask, or C-V mask. It is now often referred to in the speech research literature as the Rothenberg Mask (see, e.g., McLean, supra).

C-V masks are now produced commercially by Glottal Enterprises, the assignee of the instant invention, with screens made of either stainless steel wire or nylon mesh. (For the good high frequency measurements needed for inverse filtering, the stiffer wire screen is desirable, since screen vibration can affect the measured waveform.) A version partitioned into oral and nasal segments is also available from Glottal Enterprises.

For highest accuracy, the mask pressure to be recorded should be the differential pressure across the screen, as described by Rothenberg (1973). However, it has also been shown by Rothenberg (1977) that at the frequencies of the lower voice harmonics it may be sufficient to measure only the waveform of pressure within the mask, since the pressure external to the mask at these frequencies is much smaller and can generally be neglected. However, for highest accuracy when recording with only a microphone within the mask, the correction transfer function given by Rothenberg can be used (Rothenberg 1977, FIG. 3).

According to the present invention, the measurement of oral or nasal airflow at the voice fundamental frequency yields information about the flow that is similar to that in the low pass filtered airflow. Thus it is also important that it is known that the general shape of the waveform of the pulses of air constituting the laryngeal sound source in voiced speech is usually conveyed by lowest 3 or 4 harmonics of the output of a C-V mask, when higher harmonics are attenuated by low pass filtering (see, e.g., Rothenberg 1977; also U.S. Patent No. 5,454,375 (inverse filtering)). The amplitudes of the higher order components reflect more the details of the shape of the laryngeal flow pulses than their amplitude.

FIG. 1 illustrates a preferred embodiment of the apparatus for the measurement of voice nasalization which displays the ratio of the amplitudes for the airflow components at or near the voice fundamental frequency of the respective nasal and oral airflows.

The mask 1 in FIG. 1 can be the Glottal Enterprises model Dual Oral/Nasal C-V mask, or its equivalent, in which a divider 2 placed against the upper lip separates the nasal airflow from oral airflow. Airflow is emitted from the nasal chamber 3 and the oral chamber 4 through one or more holes 5 in the mask wall in each chamber covered with fine-mesh wire or nylon cloth screen. The screens constitute a small resistance to the airflow that converts the flow variations to pressure variations. The pressure variations are converted to electrical signals by pressure-sensitive microphones 6 and 7, which can be omnidirectional electret microphones. Microphones 6 and 7 are coupled into the respective nasal and oral chambers 3 and 4.

The microphone outputs can be coupled into a digital computer 10 through a stereo audio input jack 12 and input to the A-D converter of a stereo audio card 11. The digitized pressure waveforms 13 and 14 can then be processed first by digital equalization filters 15 to compensate for the fact that pressure external to the mask is not being subtracted from the mask chamber pressure.

The outputs 16 of the equalizer computer programs are processed by computer programs 17 that constitute bandpass filters which suppress energy not at or near the voice fundamental frequency. This can be accomplished by having the user input at 18 his/her gender and age category via the computer's keyboard or mouse. The filter parameters would then be selected to cover the voice fundamental frequency range appropriate for that age/gender category. Alternatively, a somewhat more accurate estimate of the required bandpass filter range can be obtained by measuring the fundamental frequency range of the speech sample recorded, or of another test sample recorded for that purpose, by means of a measurement program 19, that can have as inputs the equalizer outputs 16, and then using this measured range to set the range of the bandpass filter.

The amplitudes of bandpass filter outputs 21 are measured by amplitude detection programs 22, with outputs $V_{nasal}$ (23) and $V_{oral}$ (24). The ratio of $V_{nasal}$ to $V_{oral}$ is then computed by a division algorithm 25, to yield the nasalization measure 26. The nasalization measure 26 is input to a computer display program 27, which can also receive also outputs 28 and 29 of comparator programs 31 and 32. The comparator program 31 detects when the nasalization measure 26 is significantly greater than unity, so as to indicate a likelihood that a nasal consonant is being produced.

The comparator program 32 has as inputs $V_{nasal}$ (23) and $V_{oral}$ (24) and detects when both these signals are below a preset threshold, to indicate that there is either no voice being produced by the user or, alternatively, that, though voice is produced, both the oral and nasal airflow pathways are occluded, as may occur in the closure for a properly produced voiced stop such as /b/ in English. The display program 27 uses the inputs 26, 28, and 29 to generate a display for the user on monitor 35.

Figure 2A:
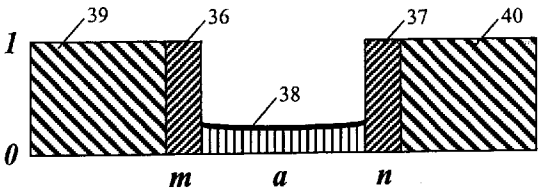
FIG. 2A is a display of nasalization ratios over time corresponding to the word "man" pronounced correctly.

FIGS. 2A through 2D present in idealized form some typical displays that can be constructed by the display program 27 and presented on monitor 35, for some illustrative words and phrases, with the horizontal axes depicting time. FIG. 2A shows an idealized display corresponding to the word "man", pronounced correctly. The nasal consonants initiating and ending the word are shown in the display by narrow shaded slanting bars 36 and 37, respectively, which can be displayed in the computer as a distinctive color, such as blue. These nasal consonant bars show the period of time during which the nasalization measure 26 is significantly greater than unity and $V_{nasal}$ is above the threshold value of comparator 32. The nasalization ratio trace 38 between the two said vertical bars 36 and 37 would indicate a typical normal production of the vowel in "man", which is expected to be slightly nasalized because of the neighboring /m/ and /n/, therefore the bar height is not at zero (no nasalization), but is significantly closer to zero than it is to unity. The area below the trace (shaded with narrow vertical bars) could be displayed in a second distinctive color, such as red. Bars of a neutral color, such as yellow, could be used to indicate the lack of projected voice, that is, little or no voiced nasal or oral airflow. Under this convention, the areas 39 and 40 (wide slanting bars), representing silent time intervals before and after the word, respectively, would be yellow.

Figure 2B:
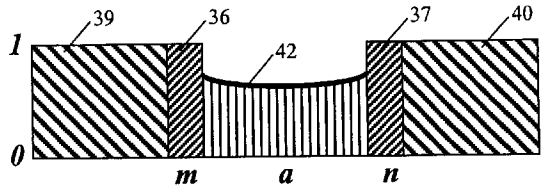
FIG. 2B is a display of nasalization ratios over time corresponding to the word "man" pronounced with a hypemasalized vowel.

FIG. 2B shows an idealized display corresponding to the word "man", pronounced nasalized. The only difference from FIG. 2A expected is that the trace between the two vertical bars 42 is closer to the level of unity (the level for a maximally nasalized vowel) than is trace 38 in FIG. 2A, indicating a hypernasalized vowel.

Figure 2C:
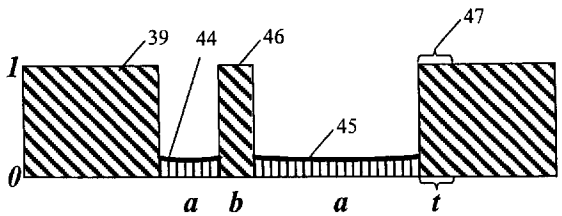
FIG. 2C is a display of nasalization ratios over time corresponding to the phrase "a bat" pronounced correctly.

FIG. 2C presents an illustrative display for a normal production of the English phrase "a bat". In this figure, the vowel nasalization ratio traces during the two vowels, labeled 44 and 45, show little or no nasalization, with the trace during each vowel remaining close to zero. The vertical bar for the closure of the /b/, 46, would be mostly yellow, since there is little or no projected voice airflow. Since both the oral closure for the /t/ (47) and the interval of aspiration following the release of the closure also show no projected voiced airflow, those intervals would also be yellow.

Figure 2D:
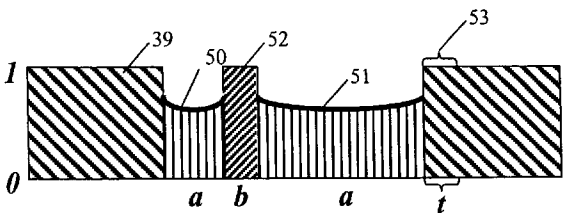
FIG. 2D is a display of nasalization ratios over time corresponding to the phrase "a bat" pronounced with nasalized vowels and nasal emission during both consonants.

FIG. 2D depicts a production of the same phrase, "a bat", but with nasalized vowels and nasal emission during both consonants. The vowel traces 50 and 51 would be closer to unity, indicating that the vowels were nasalized. The vertical bar 52 generated by the oral closure of the /b/ may be entirely or partially blue, indicating a release of voiced nasal airflow. The time interval 53 corresponding to oral closure for the consonant /t/ would be expected to be yellow, as in the pattern for the normal production 47 in FIG. 2C, even though there may be nasal airflow, since the airflow would not be voiced (assuming that the laryngeal function is normal).

Figure 3:
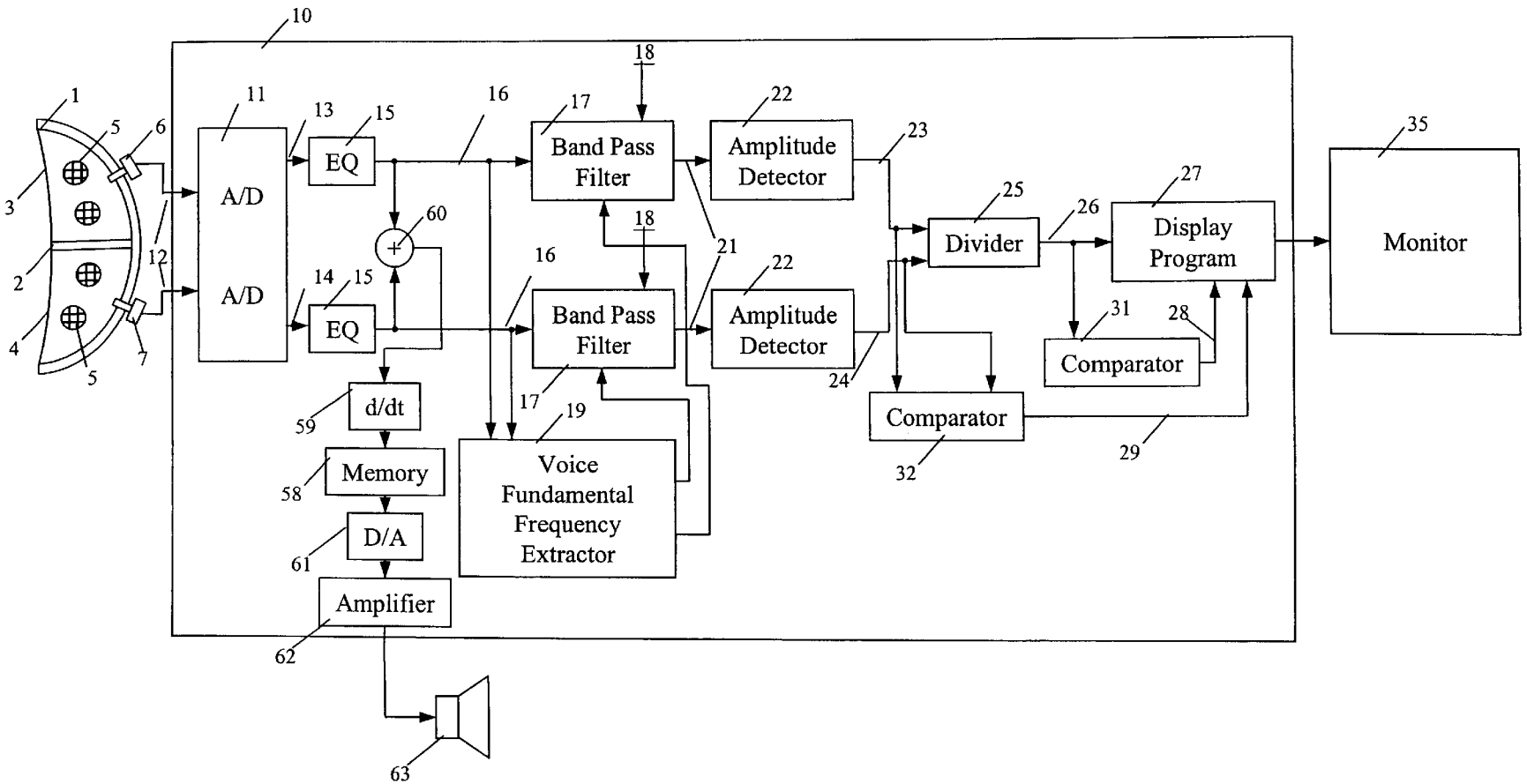
FIG. 3 is a block diagram of an alternative device for the detection, measurement, and display of nasalization including audio playback of the speech being displayed.

FIG. 3 illustrates another preferred embodiment of the invention including a digital memory 58 for at least the oral airflow waveform and preferably both the summed oral and nasal airflow waveforms. The digital differentiation stage 59 converts the airflow to an approximation of radiated acoustic sound pressure. On a command from the user, this memory containing the reconstructed radiated acoustic sound pressure waveform can be played back through the computer's internal sound card's D-A converter 61 and amplifier 62, to loudspeaker or earphones 63. During this audio playback, a cursor can be made to move across the display of the nasalization measure, so that the user can correlate the audio with the display features.

Figure 4:
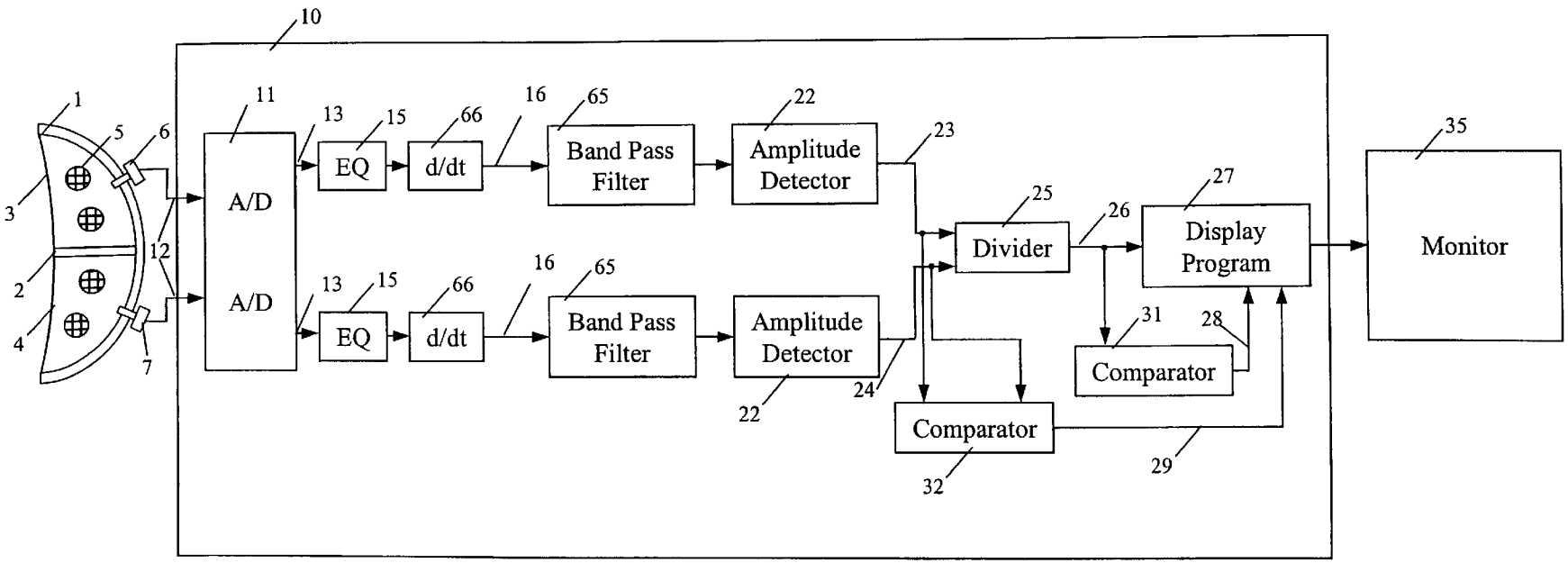
FIG. 4 is a block diagram of a device for the detection, measurement, and display of nasalization including oral and nasal signal integration stages.

FIG. 4 illustrates another embodiment in which the bandpass filters, now identified as 65, are chosen to have a bandwidth that encompasses at least the range of the vowel first formant for a wide range of vowels, and could be chosen to have a range of approximately 300 to 700 Hz. In the embodiment of FIG. 4, a stage of differentiation 66 is added to the filter processing, so that the amplitude detectors 22 are measuring a quantity approximating the radiated acoustic energy in the chosen frequency band. Thus this embodiment emulates present microphone-based methods, but with improved channel separation afforded by maskbased airflow measurement, and with no dependence on microphone directivity characteristics and location, and no dependence on the dimensions of a separator.

The embodiment of FIG. 4 can be implemented simultaneously with the embodiment of FIG. 1 or FIG. 3, so that the user could see on the monitor screen simultaneously the traces derived from fundamental frequency airflow energy (FIG. 1 or FIG. 3) and from acoustic energy (FIG. 4).

In any of the above embodiments, a memory for the display graphic provides for the simultaneous display of the user's current production and either the pattern from a previous production or the pattern from a model production provided by a teacher or a teaching program.

Figure 5:
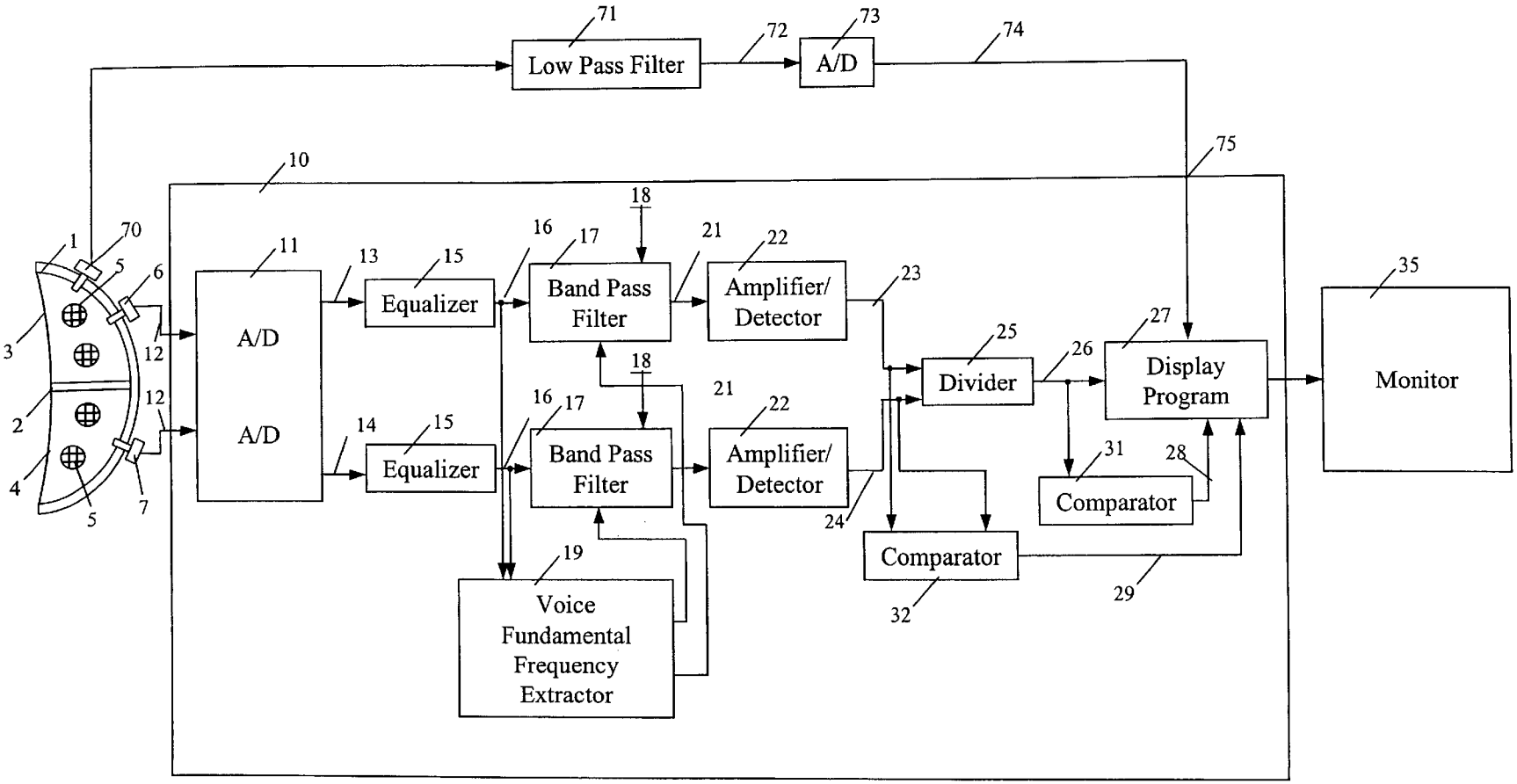
FIG. 5 is a block diagram of a device for the detection, measurement, and display of nasalization including the detection, processing and display of nasal air emissions produced during unvoiced consonants.

FIG. 5 illustrates a further embodiment in which the display presented to the user also has information about nasal emission of air during those unvoiced consonants in which a buildup of oral air pressure is required for proper pronunciation, as /t/ or /s/ in English. In the embodiment of FIG. 5, the nasal chamber 3 of mask 1 also is connected to a low frequency pressure transducer 70, which can be a Glottal Enterprises model PTL-1, with a frequency range that includes zero frequency (constant pressure). The output of low frequency transducer 70 is provided to a low pass filter 71 that removes voice frequency energy and which can be a Bessel-type low pass filter having a cutoff frequency at about 35 Hz. The output 72 of the low pass filter 71 is input to an A-D converter 73 having an output 74 which enters a communication port 75 of the computer 10, to be input to the display program 27.

Figure 6A:
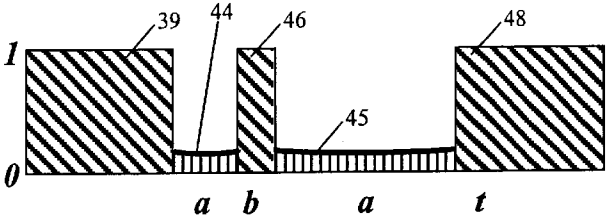
FIG. 6A is a display of nasalization ratios over time corresponding to the phrase "a bat" pronounced correctly.
Figure 6B:
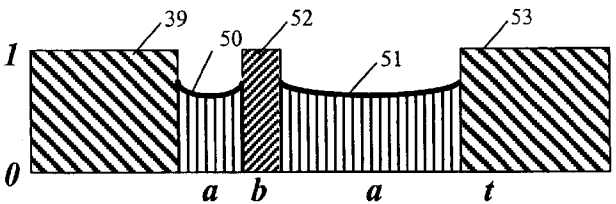
FIG. 6B is a display of nasalization ratios over time corresponding to the phrase "a bat" pronounced with nasalized vowels and nasal emission during both consonants.

FIG. 6 presents a display pattern that might be derived from normal and nasalized productions of the phrase "a bat" corresponding to FIG. 2C (non-nasalized) and FIG. 2D (nasalized), respectively. FIG. 6A and FIG. 6B show the pattern of FIG. 2C and FIG. 2D, respectively, as they might be obtained from the embodiment of FIG. 1. In the display for the nasalized production, FIG. 6B, there would be no distinction made for the unvoiced nasal emission during the oral closure of the /t/ (53).

Figure 6C:
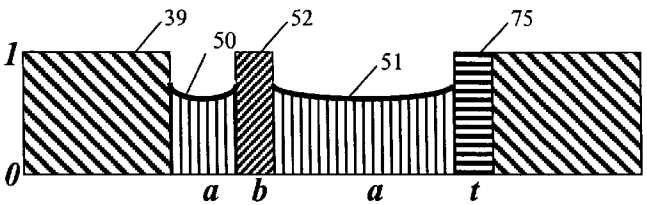
FIG. 6C is a display of nasalization ratios over time supplemented by a display of low frequency components of nasal airflow corresponding to the phrase "a bat" pronounced with nasalized vowels and nasal emission during both consonants.

FIG. 6C shows a possible display produced by the embodiment of FIG. 5. In this display, a vertical bar 75 during the /t/ closure, of a prominent color such as green, is displayed during such time period that nasal emission is indicated by the signal 72.

Figure 7:
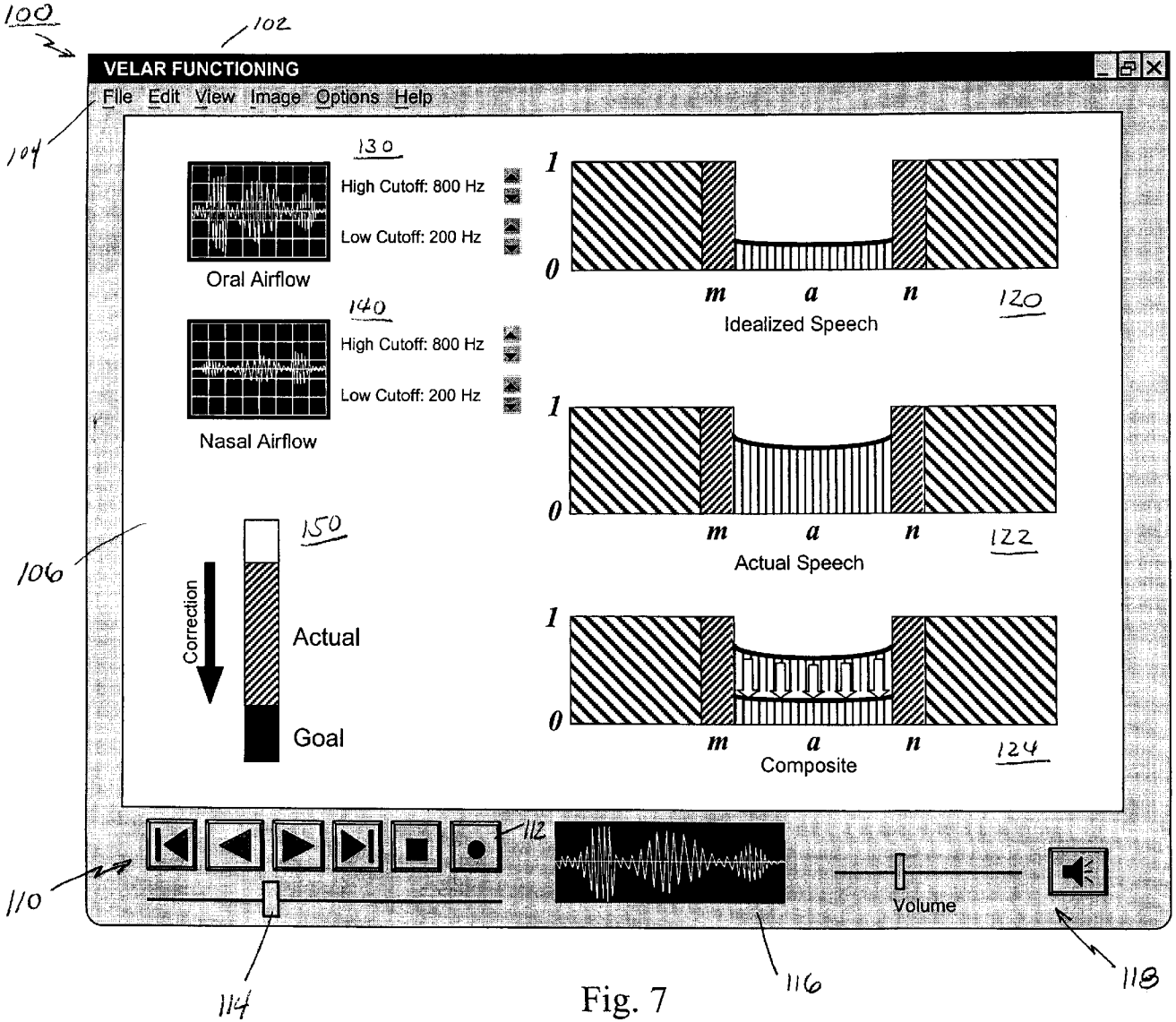
FIG. 7 is a screen presentation providing a velar function analysis application running in a Windows® environment.

FIG. 7 depicts a display screen generated by a computer application embodying the invention running under a Windows® operating system environment. Presentation 100 includes typical Windows® components including title bar 102, menu bar 104, and active display area 106. At the bottom of the display are various tape recorder type controls for recording and playing back utterances made by a subject, including controls 112 and slide bar 114 used to indicate and control audio playback. An oscilloscope-type display 116 near the bottom of the window provides a display of audio input and output signal levels over time or, alternatively, may be selected to provide frequency domain information in the form of a spectral display. Also included are typical audio output controls for volume and speaker muting.

Active display area 106 includes separate waveform presentations for the oral and nasal airflow components corresponding to those being input or previously recorded by the subject or as previously stored as templates representing desired or idealized vocalizations. Each display also has associated with it controls for setting the high and low frequency cutoff points of the oral and nasal bandpass filters.

The right half of active display area 106 includes a desired or idealized vocalization pattern 120, the vocalization pattern corresponding to the subject's speech 122 and a composite presentation 124. In addition to overlaying the subject's vocalization onto the idealized or target response, composite display 124 may include indicators such as in the form of arrows depicting the desired change required to match the subject's speech to the target vocalization, and provide time normalization to compensate for differences in speaking rate. In addition to the display presentations provided in the right portion of display area 106, a simplified display 150 may be included which presents only the aberrant vocalization segment being targeted for correction. Thus, simplified display 150 in the subject example displays the subject's vocalization of the nasalized vowel "a" (area shown with slanting bars) together with a goal vocalization (solid colored segment of the display). Also shown is an arrow indicating the desired direction of movement of the bar corresponding to a desired modification of the subject's vocalization so as to achieve the target vocalization.

In summary, as implemented by the preferred embodiments, the voice frequency airflow components emanating from the nose and mouth are analyzed and compared. By comparing the nasal and oral airflow components at the voice fundamental frequency, a nasalization measure for voice speech sounds is formed which emulates methods that compare low frequency nasal and oral airflow during voiced speech, while eliminating or greatly reducing the problems associated with comparing these low frequency airflows directly. Further, by comparing the energy of nasal and oral airflow components covering a frequency range of at least the lowest vocal tract resonance (the 'first formant'), a nasalization measure for speech sounds is formed which emulates methods that compare nasal and oral radiated acoustic sound pressure over the same frequency range, while eliminating or greatly reducing the problems associated with the pressure-based methods. A circumferentially vented screen mask (C-V mask) is used on the test subject and is configured with separate nasal and oral chambers to separate the two airflows. This configuration of the C-V mask results in only minimal distortion and muffling of the voice. It has been shown that airflow components to over 1 kHz can be measured reliably with this type of mask, a range adequate for the measurement of nasality. Since the measurement of the voice frequency airflows can be implemented with only a mask, two inexpensive microphone elements, and suitable software running on a standard multimedia digital computer, inexpensive versions suitable for home use in training regimes are possible.

The method and system may, of course, be carried out in specific ways other than those set forth herein without departing from the spirit and essential characteristics of the invention. Therefore, the presented embodiments should be considered in all respects as illustrative and not restrictive and all modifications falling within the meaning and equivalency range of the appended claims are intended to be embraced therein.

What is claimed is:

1. An apparatus for indicating speech characteristics comprising:

detectors sensitive to respective oral and nasal airflows to provide respective oral and nasal airflow signals over a predetermined usable frequency response range;

a filter receiving said oral and nasal signals and configured to attenuate energy at frequencies outside a predetermined range of voice frequencies to provide filtered oral d nasal signals;

a processor configured to calculate a ratio value reflecting a ratio of (i) an energy value of said filtered oral signal and (ii) an energy value of said filtered nasal signal; and a visual display configured to provide an indication of said ratio value, wherein at least one of said detectors comprises a limiting device for restricting an airflow and a pressure transducer configured to detect an air pressure differential caused by said limiting device.

2. The apparatus according to claim 1 further comprising a mask shaped to simultaneously cover the mouth and nose of a subject and having separate oral and nasal chambers for directing respective said oral and nasal airflows.

3. The apparatus according to claim 2 wherein said mask comprises a dual oral/nasal circumferentially vented screen mask having pressure microphones respectively coupled to said oral and nasal chambers of said mask.

4. The apparatus according to claim 1 wherein said detectors comprise respective oral and nasal airflow transducers.

5. The apparatus according to claim 1 wherein said detectors comprise respective velocity-sensitive microphones.

6. The apparatus according to claim 1 further comprising a converter receiving said filtered oral and nasal signals to provide a digital format signal, and a digital computer responsive to a stored program of instructions and comprising said filter and said processor.

7. The apparatus according to claim 1 further comprising a signal differentiator configured for proving a value representing a time rate of change of said oral and nasal airflow signals.

8. The apparatus according claim 1 further comprising a memory storing idealized templates representing normal speech corresponding to predetermined utterances.

9. The apparatus according to claim 1 further comprising a processor configured to calculate a ratio represented by said low frequency component of said nasal airflow divided by a sum of (a) a low frequency component of said oral airflow plus (b) said low frequency component of said nasal airflow.

10. The apparatus according to claim 1 further including an audio reproduction device storing and reproducing audio frequency components of said oral airflow signal.

11. An apparatus for measuring the degree of closure of the oronasal passageway during speech comprising:

a mask shaped to simultaneously cover the mouth and nose of a subject and having separate oral and nasal chambers for directing respective oral and nasal airflows;

oral and nasal transducers in respective communication with said oral and nasal chambers, each of said oral and nasal transducers operative to respectively detect said oral and nasal airflows to provide respective oral and nasal airflow signals over a predetermined usable frequency response range;

oral and nasal signal bandpass filters respectively receiving said oral and nasal airflow signals from said oral and nasal transducers and supplying respective filtered oral and nasal signals in which energy at frequencies outside a predetermined voice fundamental frequency range is substantially attenuated;

a comparator providing a ratio value reflecting a ratio of (i) an energy value of said filtered nasal signal and (ii) an energy value of said filtered oral signal; and a display providing an indication of said ratio value, wherein a frequency response range of said oral and nasal transducers includes a predetermined multiplicity of human voice harmonics up to and including 800 Hz; and bandpasses of said oral and nasal signal bandpass filters include at least a lowest formant of the human vocal tract for most vowels produced by the class of speakers for which the apparatus is intended, said oral and nasal signal bandpass filters each having lower and upper frequency half-power points of approximately 300 and 700 Hz, respectively.

12. The apparatus according to claim 11 wherein said mask is a dual oral/nasal circumferentially vented screen mask and said oral and nasal transducers are pressure microphones respectively coupled to said oral and nasal chambers of said mask.

13. The apparatus according to claim 11 wherein said oral and nasal airflow signals are supplied to an analog-to-digital converter of a digital computer and said (i) oral and nasal signal bandpass filters, (ii) comparator, and (iii) display are implemented by program instructions executed by said digital computer, an output of said display being provided on a computer monitor.

14. The apparatus according to claim 11 wherein:

a frequency response range of said oral and nasal transducers includes an expected range of voice fundamental frequencies which can be 75–350 Hz for speech; and bandpasses of said oral and nasal signal bandpass filters that can be chosen to match the fundamental frequency range of a particular speaker.

15. The apparatus according to claim 11, wherein said oral and nasal signal bandpass filters each have lower and upper half-power points within the ranges of 200 to 450 Hz and 550 to 800 Hz, respectively.

16. The apparatus according to claim 11, wherein said oral and nasal signal bandpass filters each have lower and upper half-power points within the respective ranges of 200 to 450 Hz and 550 to 800 Hz, respectively.

17. The apparatus according to claim 11, wherein at least one of said oral and nasal signal bandpass filters has a nominal lower half-power point of 350 Hz and an upper half power point of 650 Hz, respectively.

18. The apparatus according to claim 11, wherein said oral and nasal bandpass filters each include a signal differentiator operable to provide a signal representing changes in said oral and nasal airflow signals with respect to time within the passband of the filters.

19. The apparatus according to claim 11 further comprising an audio signal recorder configured for storing and reproducing audio frequency components of said oral airflow signal corresponding to speech sounds.

20. The apparatus according to claim 11 further comprising an audio signal recorder configured for storing and reproducing audio frequency components of said oral and nasal airflow signals corresponding to speech sounds.

21. The apparatus according to claim 20 further comprising a controller operative to synchronize functioning of said display and said audio signal recorder.

22. An apparatus for measuring the degree of closure of the oronasal passageway during speech comprising:

a mask shaped to simultaneously cover the mouth and nose of a subject and having separate oral and nasal chambers for directing respective oral and nasal airflows;

oral and nasal transducers in respective communication with said oral and nasal chambers, each of said oral and nasal transducers operative to respectively detect said oral and nasal airflows to provide respective oral and nasal airflow signals over a predetermined usable frequency response range;

oral and nasal signal bandpass filters respectively receiving said oral and nasal airflow signals from said oral and nasal transducers and supplying respective filtered oral and nasal signals in which energy at frequencies outside a predetermined voice fundamental frequency range is substantially attenuated;

a comparator providing a ratio value reflecting a ratio of (i) an energy value of said filtered nasal signal and (ii) an energy value of said filtered oral signal;

a display providing an indication of said ratio value;

a low frequency nasal chamber transducer configured for providing a nasal low frequency signal corresponding to low frequency airflow components of said nasal airflow including the zero frequency (constant flow) component; and a low frequency lowpass filter configured to attenuate voice frequency energy from an output of said low frequency nasal chamber transducer.

23. The apparatus according to claim 22 wherein said low frequency bandpass filter has a high frequency half power point within a range of 20 to 40 Hz.

24. The apparatus according to claim 22 further comprising a low frequency oral chamber transducer configured to provide an oral low frequency signal corresponding to low frequency airflow components of said oral airflow.

25. The apparatus according to claim 24 further comprising a low frequency comparator configured for computing a ratio of a value of said nasal low frequency signal to a value of said oral low frequency signal.

26. The apparatus according to claim 25 wherein said low frequency comparator includes means for computing (i) said value of said nasal low frequency signal divided by (ii) a value representing a sum of (a) said value of said oral low frequency signal plus (b) said value of said nasal low frequency signal.

27. The apparatus according to claim 26 further comprising a controller operative to synchronize functioning of said display and said audio signal recorder.

28. The apparatus according to claim 22 further comprising a low frequency display providing an indication of said low frequency airflow components of said nasal airflow.

29. An apparatus for measuring the degree of closure of the oronasal passageway during speech comprising:

a mask shaped to simultaneously cover the mouth and nose of a subject and having separate oral and nasal chambers for directing respective oral and nasal airflows;

oral and nasal transducers in respective communication with said oral and nasal chambers, each of said oral and nasal transducers operative to respectively detect said oral and nasal airflows to provide respective oral and nasal airflow signals over a predetermined usable frequency response range;

oral and nasal signal bandpass filters respectively receiving said oral and nasal airflow signals from said oral and nasal transducers and supplying respective filtered oral and nasal signals in which energy at frequencies outside a predetermined voice fundamental frequency range is substantially attenuated;

a comparator providing a ratio value reflecting a ratio of (i) an energy value of said filtered nasal signal and (ii) an energy value of said filtered oral signal;

a display providing an indication of said ratio value;

a low frequency transducer means for measuring low frequency airflow components of at least one of (i) said nasal airflow and (ii) both said nasal and oral airflows, including the zero frequency (constant flow) components; and low frequency filtering means for attenuating voice frequency energy from the outputs of said low frequency transducer means and having upper frequency half-power points within a range of 20 to 40 Hz.

30. The apparatus according to claim 29 further comprising a low frequency nasal airflow comparison and display means that determines the periods of time during which the low frequency nasal airflow is greater than a predetermined level deemed not acceptable and the voiced nasal airflow is lower than a predetermined level deemed to indicate the presence of voicing, and present to the user a display feature indicating the presence of unvoiced nasal emissions during the said periods of time.

31. The apparatus according to claim 30 wherein the said indicating feature includes an indication of a level on a numerical scale of either (i) the level of unvoiced nasal airflow, or (ii) a quantity comparing said nasal airflow to said oral airflow.

32. The apparatus according to claim 29 further comprising low frequency comparison means for computing a ratio of (i) said low frequency airflow components of said nasal airflow and (ii) said low frequency airflow component of said oral airflow.

33. The apparatus according to claim 30 wherein said low frequency comparison means includes means for computing a ratio of (i) said low frequency airflow components of said nasal airflow divided by (ii) a sum representing said low frequency airflow components of said nasal and oral airflows.

34. A method of measuring the degree of closure of the oronasal passageway during speech comprising the steps of:

detecting oral and nasal airflows to provide respective oral and nasal airflow signals over a predetermined usable frequency response range;

filtering said oral and nasal signals to attenuate energy at frequencies outside a predetermined range of voice frequencies so as to provide filtered oral and nasal signals and attenuate signals having a frequency outside of a range of approximately 200 to 800 Hz;

calculating a ratio value reflecting a ratio of (i) an energy value of said filtered oral signal and (ii) an energy value of said filtered nasal signal; and displaying an indication of said ratio value.

35. The method according to claim 34 further comprising a step of simultaneously covering the mouth and nose of a subject with a mask having separate oral and nasal chambers for directing respective said oral and nasal airflows.

36. The method according to claim 34 further comprising a step of providing a dual oral/nasal circumferentially vented screen mask having pressure microphones respectively coupled to said oral and nasal chambers of said mask.

37. The method according to claim 34 further comprising the steps of converting said filtered oral and nasal signals to a digital format and wherein said steps of filtering and calculating are performed by a digital computer in response to a stored program of instructions.

38. The method according to claim 34 wherein said filtering step attenuates energy not at the voice fundamental frequency.

39. The method according to claim 38 further comprising measurement of the amplitudes of the outputs of the filtering step.

40. The method according to claim 34 further comprising a step of differentiating said oral and nasal airflow signals with respect to time.

41. The method according to claim 40 further comprising measurement of the amplitudes of the outputs of the filtering step.

42. The method according to claim 34 further comprising measurement of the amplitudes of the outputs of the filtering step.

43. The method according to claim 34 further including steps storing and reproducing audio frequency components of said oral airflow signal.

44. A method of measuring the degree of closure of the oronasal passageway during speech comprising the steps of:

detecting oral and nasal airflows to provide respective oral and nasal airflow signals over a predetermined usable frequency response range;

filtering said oral and nasal signals to attenuate energy at frequencies outside a predetermined range of voice frequencies so as to provide filtered oral and nasal signals;

calculating a ratio value reflecting a ratio of (i) an energy value of said filtered oral signal and (ii) an energy value of said filtered nasal signal;

displaying an indication of said ratio value;

detecting a low frequency component of said nasal airflow;

providing a low frequency nasal signal in response to said detecting step; and lowpass filtering said low frequency nasal signal to attenuate the voice frequency energy.

45. The method according to claim 44 wherein said step of filtering said low frequency nasal signal attenuates signals having a frequency of greater than 40 Hz by at least 3 dB.

46. The method according to claim 44 further comprising a step of calculating a ratio of said low frequency component of said nasal airflow divided by a low frequency component of said sum of (a) a low frequency component of said oral airflow plus (b) said low frequency component said nasal airflow.

* * * * *